US005566526A

United States Patent [19]

Suga

[11] Patent Number: 5,566,526

[45] Date of Patent: Oct. 22, 1996

[54] DEVICE MOTOR CONTROLLING APPARATUS FOR USE IN PACKAGING MACHINE

[75] Inventor: Yasutaka Suga, Ibaraki, Japan

[73] Assignee: Ibaraki Seiki Machinery Company, Ltd., Osaka-fu, Japan

[21] Appl. No.: 519,572

[22] Filed: Aug. 25, 1995

[51] Int. Cl.[6] ..... B65B 9/06; B65B 51/26; B65B 51/30

[52] U.S. Cl. ..... 53/75; 53/550; 53/389.4

[58] Field of Search ..... 53/504, 51, 75, 53/550, 551, 552, 389.4, 389.5, 450

[56] References Cited

U.S. PATENT DOCUMENTS

| | | | |
|---|---|---|---|
| 4,506,488 | 3/1985 | Matt et al. | 53/450 X |
| 4,525,977 | 7/1985 | Matt | 53/450 X |
| 4,574,566 | 3/1986 | Eaves et al. | 53/450 |
| 4,712,357 | 12/1987 | Crawford et al. | 53/450 |
| 4,722,168 | 2/1988 | Heaney | 53/450 |
| 4,909,018 | 3/1990 | Yamamoto | 53/450 |
| 5,079,902 | 1/1992 | Seko et al. | 53/550 X |
| 5,138,815 | 8/1992 | Groschen, Jr. | 53/550 X |

*Primary Examiner*—Horace M. Culver
*Attorney, Agent, or Firm*—Barnes, Kisselle, Raisch, Choate, Whittemore & Hulbert, P.C.

[57] ABSTRACT

There is disclosed an apparatus for use in a bag forming/filling/sealing machine for controlling the operations of a film transportation motor (10) and an article transportation motor (18) based on the operation of a sealer driving motor (25) which is driven at a cyclic variable speed. The rotation cycles of the respective motors (10, 18, 25) are determined, based on a reference pulse which is generated by a crystal oscillator (28) and input to a central processing unit (27). When a value of the length of articles (19) to be packaged is input to the central processing unit (27), the central processing unit (27) specifies constant speeds of the film transportation motor (10) and the article transportation motor (18) and a cyclic variable speed of the sealer driving motor (25). The cyclic variable speed of the sealer driving motor is properly controlled by comparing a feedback pulse generated by an encoder (33) with a reference pulse generated by the crystal oscillator (28), while the cycle offsets of the film transportation motor (10) and the article transportation motor (18) are corrected, based on the timing signal output from an electronic cam (32).

5 Claims, 4 Drawing Sheets

DEVICE MOTOR CONTROLLING APPARATUS FOR USE IN PACKAGING MACHINE

BACKGROUND OF THE INVENTION

1. Field of the Invention

The present invention relates to an apparatus for controlling the rotational speeds of drive motors provided in various sections in a bag forming/filling/sealing machine.

2. Description of Related Arts

Bag forming/filling/sealing machines are designed to form a film web into a tube, then fill therein articles to be packaged, and cut and seal the film tube. More specifically, the bag forming/filling/sealing machines form an elongated film web into a longitudinally extending tube, then feed a succession of equidistantly spaced articles to be packaged into the film tube, and cross-seal the film tube between adjacent articles, thereby forming a bag containing an article packaged therein.

A packaging machine of this kind includes at least a motor for transporting a film, a motor for transporting articles to be packaged, and a motor for pivoting a sealer. In such a packaging machine, the rotational speeds of the respective motors are controlled to time the rotations of the respective motors by means of a microcomputer.

A packaging machine disclosed in U.S. Pat. No. 4,712,357, for example, controls the rotational speeds of a film transportation motor and a sealer driving motor, based on the rotational speed of an article transportation motor which is kept constant. Another packaging machine disclosed in U.S. Pat. No. 4,909,018 controls the rotational speeds of an article transportation motor and a sealer driving motor, based on the rotational speed of a film transportation motor.

These packaging machines are each designed such that the reference motor stops at a predetermined original stop position and the other two motors each stop in a preset phase relationship with respect to the reference motor when an operation stop signal is generated. In the former packaging machine, for example, the film transportation motor and the sealer driving motor are each adapted to stop in a preset phase relationship with respect to the article transportation motor when the article transportation motor stops at the original stop position in response to an operation stop signal. At this time, a sealer is brought in contact with a film, resulting in fusion of the film due to heat applied thereto by the sealer.

In general, the stop position of a motor of this type is controlled by means of a computer. Therefore, it may be easy to control the stop positions of the respective motors so as to prevent the sealer from contacting the film. When the stop position of the sealer is changed due to a change in the length of articles to be packaged or a change in the interval between adjacent marks printed on the film, however, the contact of the sealer to the film is unavoidable.

To prevent the sealer from contacting the film, the rotational speeds of the film transportation motor and the article transportation motor should be controlled on the basis of the rotational speed of the sealer driving motor. It is easy to employ the rotational speeds of the film transportation motor and the article transportation motor as reference speeds because these motors are rotated at constant speeds. However, the sealer driving motor is rotated at a cyclic variable speed not at a constant speed. For this reason, it has been difficult to employ the rotational speed of the sealer driving motor as a reference speed.

To solve the aforesaid problem, it is an object of the present invention to control the rotational speeds of a film transportation motor and an article transportation motor on the basis of the rotational speed of a sealer driving motor to prevent a sealer from contacting a film when the operation of a packaging machine is stopped.

SUMMARY OF THE INVENTION

In accordance with the present invention, there is provided an apparatus for use in a packaging machine for controlling a rotational speed of a film transportation motor for transporting an elongated film web through a tube forming means to form the film web into a continuous tube, a rotational speed of an article transportation motor for feeding a succession of equidistantly spaced articles to be packaged into the film tube from an entrance side of the tube forming means, and a rotational speed of a sealer driving motor for driving rotary sealers for cross-sealing the film tube between adjacent articles to be packaged on an exit side of the tube forming means, thereby running the respective motors at speeds interrelated with each other, the apparatus including: a timing means for outputting a signal for every pivoting of shafts of the rotary sealers; a rotational angle division detecting means for outputting a multiplicity of pulse signals by subdividing a rotational angle of the shafts of the rotary sealers; a reference pulse generator for generating a micropulse as a reference pulse; a cycle determining means for determining drive cycles of the respective motors based on the micropulse generated by the reference pulse generator; a rotational speed determining means for determining rotational speeds of shafts of the respective motors in a cycle determined by the cycle determining means; a cyclic variable speed determining means for determining a cyclic variable speed of the sealer driving motor based on numerical data indicative of a size of the articles input from an input device and by comparing the pulse output from the rotational angle division detecting means with the reference pulse generated by the reference pulse generator; and a cycle offset correcting means for correcting cycle offsets of the film transportation motor and the article transportation motor by comparing pulses output from encoders respectively provided to the film transportation motor and the article transportation motor with the signal output from the timing means.

The reference pulse generator outputs, for example, 120 pulse signals per second and, in this case, it is assumed that one cycle is specified by 120 pulse signals. The rotational speed determining means determines angular velocities of the shafts of the respective motors. Thus, the rotational speeds of the article transportation motor, the film transportation motor and the sealer driving motor are specified.

The cyclic variable speed of the sealer driving motor for one shaft rotation is determined, with reference to data read out of a memory when the length of the articles to be packaged is input from the input device, and by comparing the shaft rotation pulse signal of the sealer driving motor output from the rotational angle division detecting means with the reference pulse signal generated by the reference pulse generator. The shaft of the sealer driving motor is rotated at the cyclic variable speed thus determined.

The cycle offsets of the film transportation motor and the article transportation motor are corrected by comparing the signal output from the timing means provided to the shaft of the sealer driving motor with the pulse signals output from the encoders of the film transportation motor and the article transportation motor. This allows the film transportation motor and the article transportation motor to be correctly driven, based on the operation of the sealer driving motor.

In the motor speed controlling apparatus of the present invention, the rotation cycles of the respective motors are determined on the basis of the pulse signal generated by the pulse generator, and the cycle offsets of the film transportation motor and the article transportation motor with respect to the sealer driving motor are detected by comparing the signal output from the timing means provided to the shaft of the sealer driving motor with feedback pulse signals output from the film transportation motor and the article transportation motor, whereby the cycle offsets among the three motors are corrected. By thus controlling the cycle offsets, the film transportation motor and the article transportation motor are driven on the basis of the operation of the sealer driving motor and, therefore, the sealers can be stopped at the original stop position to be prevented from contacting the film when the operation of the packaging machine is stopped. Even if the length of articles to be packaged or the interval between adjacent marks printed on the film is changed, the film web and the articles on a conveyor are transported while the sealer is located at the original stop position. Thus, the fusion of the film can be prevented, which may otherwise occur due to heat applied thereto by the sealers when the operation of the packaging machine is stopped.

The foregoing and other objects, features and advantages of the present invention will be apparent from the following detailed description of preferred embodiments of the invention with reference to the attached drawings.

DETAILED DESCRIPTION OF THE PREFERRED EMBODIMENTS

One preferred embodiment of the present invention will hereinafter be described with reference to FIGS. 1 to 5.

Figure 1:
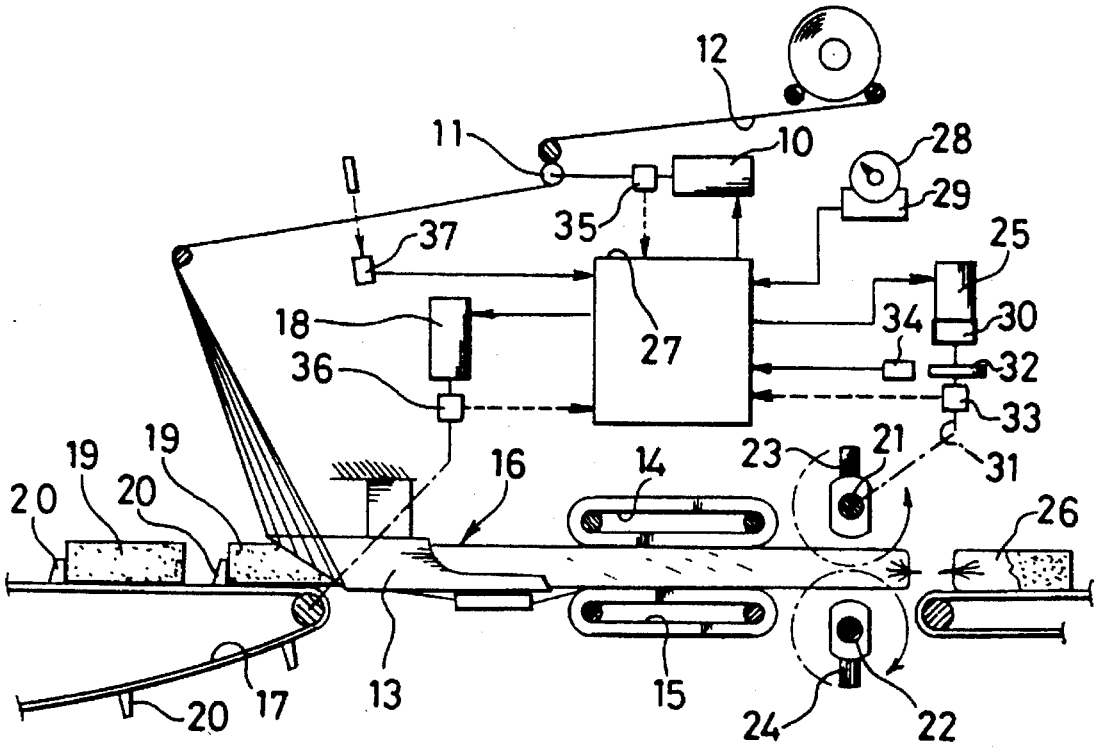
FIG. 1 is a side elevation of an apparatus of the present invention.

As shown in FIG. 1, feed rolls 11 rotated by a first motor 10 pays out and feeds an elongated film web 12 to a tube forming means 13. The film web 12, which is tautened by the rotation of upper and lower belts 14 and 15 disposed downstream of the tube forming means 13, is formed into a tube 16 when passing through the tube forming means 13.

A belt conveyor 17 disposed on an entrance side of the tube forming means 13 is continuously rotated by power of a second motor 18, whereby articles 19 to be packaged are successively pushed out by attachments 20 attached onto the outer periphery thereof, and equidistantly fed into the film tube 16.

Sealers 23 and 24 are respectively provided around a pair of shafts 21 and 22 disposed downstream of the belts 14 and 15 in a parallel relation with respect to the axes of the shafts 21 and 22. The shafts 21 and 22 are coupled with each other via a spur gear (not shown) so that the shafts 21 and 22 are pivoted in opposite directions when the shaft 21 is driven by a third motor 25. By thus driving the shafts 21 and 22, the sealers 23 and 24 intermittently press the film tube from the upper and under sides thereof to fuse the pressed portion of the film tube and, at the same time, blade portions of the sealers 23 and 24 cut the film tube. Thus, a bag 26 can be formed which contains an article packaged therein.

A shaft 31 of the third motor 25 is provided with an electronic cam 32 and a third encoder 33. The electronic cam 32 contacts a switch 34 every time the shaft 31 rotates once, and the rotation cycle of the shaft 31 is input to the central processing unit 27. A pulse signal output from the third encoder 33 indicative of a rotational angle division of the shaft 31 is fed back to the central processing unit 27, which controls the rotation of the third motor 25 so that the shaft 31 is rotated exactly once a second.

Figure 2:
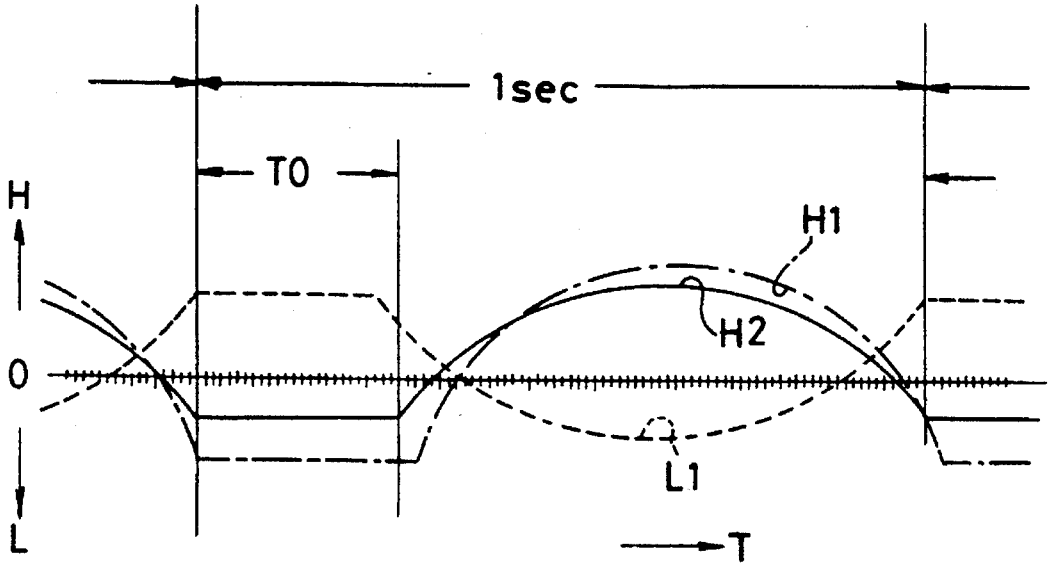
FIG. 2 is a graphical representation illustrating a cyclic variable speed of a sealer driving motor.
Figure 3:
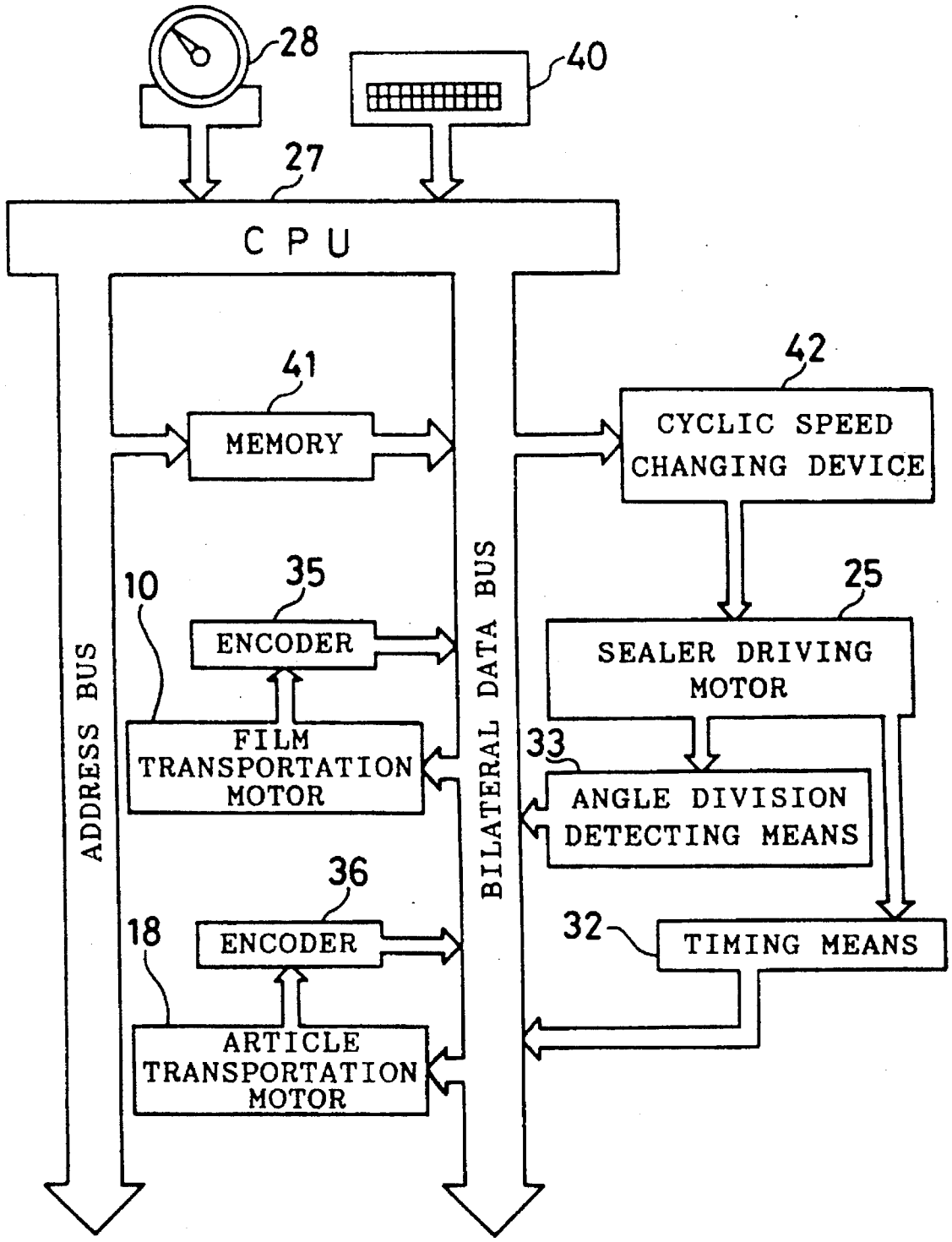
FIG. 3 is a diagram illustrating the construction of the apparatus.

A reference pulse generator 28 (see FIG. 4) connected to a microprocessor or the central processing unit 27 generates, for example, 120 electrical pulses per second. It is preferred in terms of accuracy that the reference pulse generator 28 includes a crystal oscillator as a signal source. A cycle determining device 29 connected to the reference pulse generator 28 has a function to specify one cycle to be, for example, 120 pulses. As shown in FIG. 2, one cycle (120 pulses) is specified to be one second and, therefore, the sealer 23 is rotated once a second by power output from the third motor 25 through a decelerator 30.

The rotational speed determining means **29*a* generates a signal to apply an instruction to the first motor 10 via the central processing unit 27 to control the film transportation so that marks printed on the film 12 move ahead by one pitch per second. The marks printed on the film are detected by a sensor 37. The rotational speed determining means 29*a* also applies an instruction to the second motor 18 via the central processing unit 27 to control the transportation of the articles so that the attachments 20 provided on the belt conveyor 17 move ahead by one pitch per second. Feedback signals output from first and second encoders 35 and 36 respectively attached to shafts of the first and second motors 10 and 18 are used to control the rotational speeds of the first and second motors 10 and 18**.

When a value of a length of the articles to be packaged is input to the central processing unit 27 from an input device 40 (see FIGS. 3 and 4), information corresponding to the input value is read out of a memory 41. The read out information includes data for specifying the transportation speeds of the film 12 and the articles 19 in accordance with the length of the articles 19 and data for specifying the cyclic variable speed of the third motor for the sealers 23 and 24. Therefore, the rotational speeds of the first and second motors 10 and 18 are variably set in accordance with the length of the articles 19, while the cyclic variable speed of the third motor 25 is set by a cyclic variable speed changing device 42.

Figure 5:
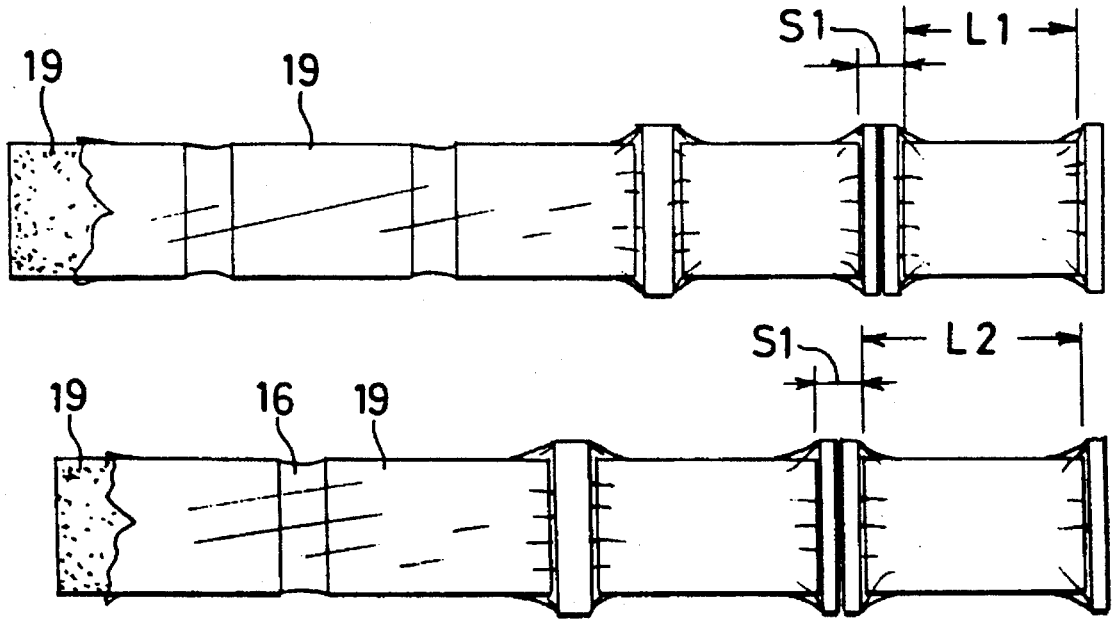
FIG. 5 is a diagram for explaining a film transportation speed which is adjusted in accordance with the length of articles to be packaged.

To properly package articles having a length L2, the transportation speeds of the film tube 16 and articles 19 should be increased in comparison with a case where articles having a shorter length L1 are packaged, if a sealing width S1 between adjacent articles 19 is not to be changed as shown in FIG. 5 and the rotation cycle of the sealer 23 is to be kept constant (one rotation per second). A period TO during which the sealers 23 and 24 are brought in contact with the film within one cycle (one second) is slightly different depending on the transportation speed of the film as shown in FIG. 2. Therefore, the rotational speed of the sealers should be variously changed (increased or decreased) as indicated by reference character H1, H2 or L1 in accordance with the transportation speeds of the film and articles when the sealers are brought away from the film, so that the sealers are pivoted in a cycle of one second (or in a cycle of 120 pulses generated by the reference pulse generator 28). Where the sealers are to be pivoted at a cyclic variable speed as indicated by a dotted line, for example, the rotational speed of the sealers is increased when the sealers contact the film, and is decreased as indicated by reference character L1 when the sealers are brought away from the film. Thus, the rotation cycle is always kept to one second.

Figure 4:
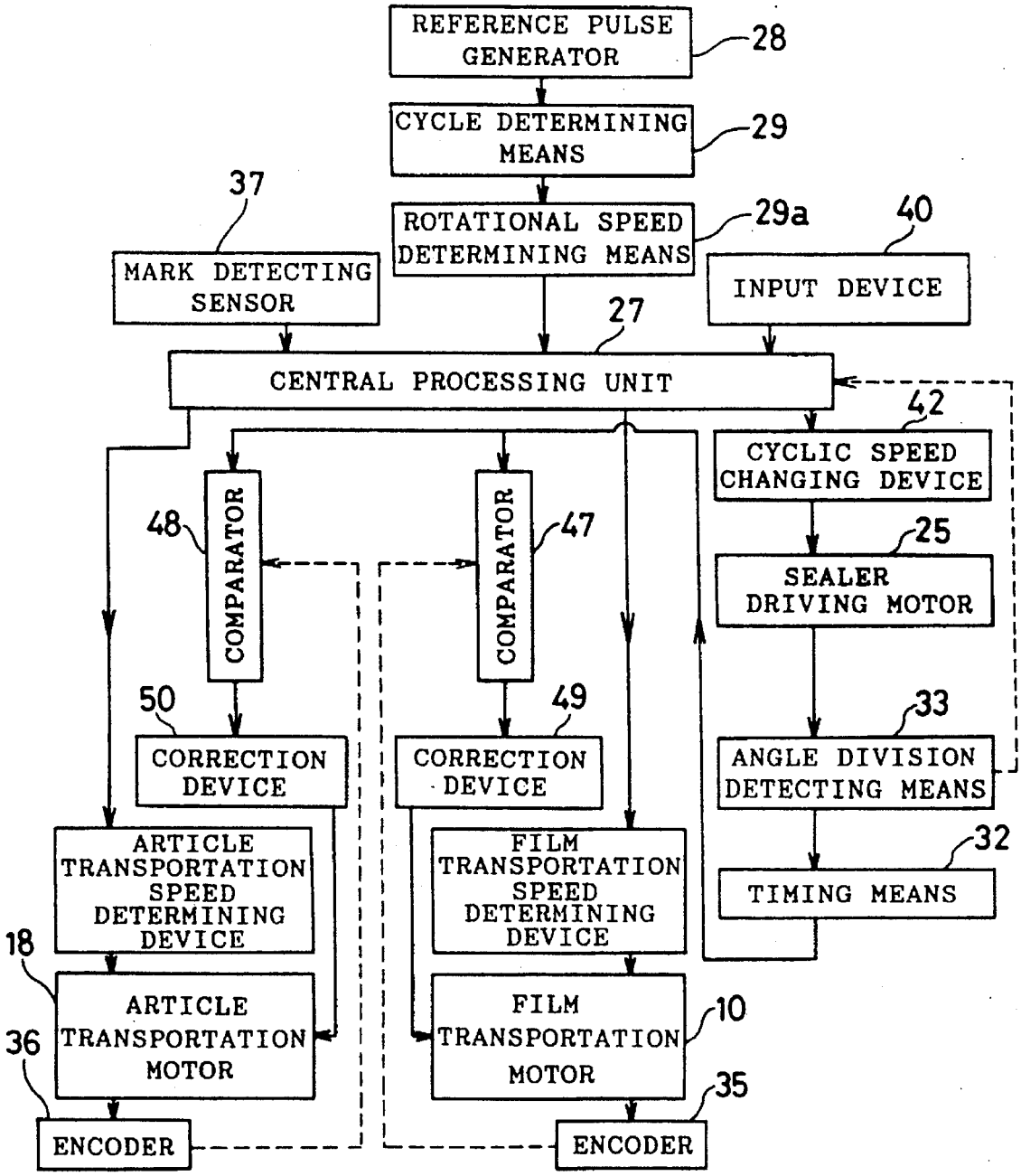
FIG. 4 is a block diagram of the apparatus.

Referring to FIG. 4, the rotational angle of the shaft of the third motor (sealer driving motor) 25 is detected by the third encoder (rotational angle division detecting means) 33, and the rotation cycle of the third motor 25 is adjusted to exactly one second or 120 pulses by feeding back the detected rotational angle to the central processing unit 27. Therefore, the cycle offsets of the first motor (film transportation motor) 10 and the second motor (article transportation motor) 18 are corrected by using signal offsets which are detected by comparing the timing signal which is output once a second from the timing means (electronic cam) 32 with pulse signals output from the first encoder 35 and the second encoder 36 by means of comparators 47 and 48.

The rotational angle division detecting means 33 may also play a role of the timing means 32 concurrently.

While only a certain presently preferred embodiment has been described in detail, certain changes and modifications can be made in the embodiment without departing from the spirit and scope of the present invention as defined by the following claims.

What is claimed is:

1. An apparatus for use in a packaging machine for controlling a rotational speed of a film transportation motor for transporting an elongated film web through a tube forming means to form the film web into a continuous tube, a rotational speed of an article transportation motor for feeding a succession of equidistantly spaced articles to be packaged into the film tube from an entrance side of the tube forming means, and a rotational speed of a sealer driving motor for driving rotary sealers for cross-sealing the film tube between adjacent articles to be packaged on an exit side of the tube forming means, thereby running the respective motors at speeds interrelated with each other, said apparatus comprising:

a timing means for outputting a signal for every pivoting of shafts of the rotary sealers;

a rotational angle division detecting means for outputting a multiplicity of pulse signals by subdividing an rotational angle of the shafts of the rotary sealers;

a reference pulse generator for generating a micropulse as a reference pulse;

a cycle determining means for determining drive cycles of the respective motors based on the micropulse generated by the reference pulse generator;

a rotational speed determining means for determining rotational speeds of shafts of the respective motors in a cycle determined by the cycle determining means;

a cyclic variable speed determining means for determining a cyclic variable speed of the sealer driving motor based on numerical data indicative of a size of the articles input from an input device and by comparing the pulse output from the rotational angle division detecting means with the reference pulse generated by the reference pulse generator; and a cycle offset correcting means for correcting cycle offsets of the film transportation motor and the article transportation motor by comparing pulses output from encoders respectively provided to the film transportation motor and the article transportation motor with the signal output from the timing means.

2. An apparatus as set forth in claim 1, wherein said timing means is an electronic cam attached to the shaft of the sealer driving motor.

3. An apparatus as set forth in claim 1, wherein said rotational angle division detecting means also plays a role of the timing means concurrently.

4. An apparatus as set forth in claim 1, wherein said reference pulse generator includes a crystal oscillator.

5. An apparatus as set forth in claim 2, wherein said reference pulse generator includes a crystal oscillator.

* * * * *